US008128398B2

(12) United States Patent
Flohr et al.

(10) Patent No.: US 8,128,398 B2
(45) Date of Patent: Mar. 6, 2012

(54) BURNER AND PILOT BURNER

(75) Inventors: Peter Flohr, Birmenstorf (CH); Ephraim Gutmark, Cincinnati, OH (US); Christian Oliver Paschereit, Berlin (DE)

(73) Assignee: ALSTOM Technology Ltd., Baden (CH)

( * ) Notice: Subject to any disclaimer, the term of this patent is extended or adjusted under 35 U.S.C. 154(b) by 2264 days.

(21) Appl. No.: 10/623,812

(22) Filed: Jul. 22, 2003

(65) Prior Publication Data

US 2004/0137395 A1 Jul. 15, 2004

(30) Foreign Application Priority Data

Jul. 22, 2002 (DE) ..... 102 33 161

(51) Int. Cl.
*F23M 9/00* (2006.01)

(52) U.S. Cl. ..... 431/8; 431/159; 431/350; 60/748; 60/777

(58) Field of Classification Search ..... 431/8, 9, 431/12, 159, 173, 182, 350; 60/748, 777
See application file for complete search history.

(56) References Cited

U.S. PATENT DOCUMENTS

| | | | | |
|---|---|---|---|---|
| 5,411,393 | A * | 5/1995 | Askin et al. | 431/8 |
| 6,056,538 | A * | 5/2000 | Buchner et al. | 431/115 |
| 6,126,439 | A * | 10/2000 | Knopfel et al. | 431/350 |
| 6,688,109 | B2 * | 2/2004 | Hein | 60/748 |
| 7,972,133 | B2 * | 7/2011 | Bernero et al. | 431/278 |

FOREIGN PATENT DOCUMENTS

| | | | |
|---|---|---|---|
| DE | 400 13 78 | * | 7/1991 |
| DE | 196 39 301 | A1 | 3/1998 |
| DE | 197 38 055 | A1 | 4/1998 |
| DE | 198 03 879 | C1 | 8/1999 |
| EP | 0 735 318 | B1 | 10/1996 |
| EP | 0 931 980 | A1 | 7/1998 |

OTHER PUBLICATIONS

Search Report from DE 102 33 161.8 (issued Oct. 29, 2003).

* cited by examiner

*Primary Examiner* — Stephen M. Gravini
(74) *Attorney, Agent, or Firm* — Cermak Nakajima LLP; Adam J. Cermak

(57) ABSTRACT

A burner for a heat generator comprises a swirl generator (1) for a combustion-air flow and means for injecting fuel for producing a main flow (6). A combustion chamber (2) is arranged downstream of the burner.
A cavity (3) is arranged between the swirl generator (1) and the combustion chamber (2), in which cavity (3) a secondary flow (10) can be produced, and this secondary flow (10) encloses the main flow (6).

5 Claims, 1 Drawing Sheet

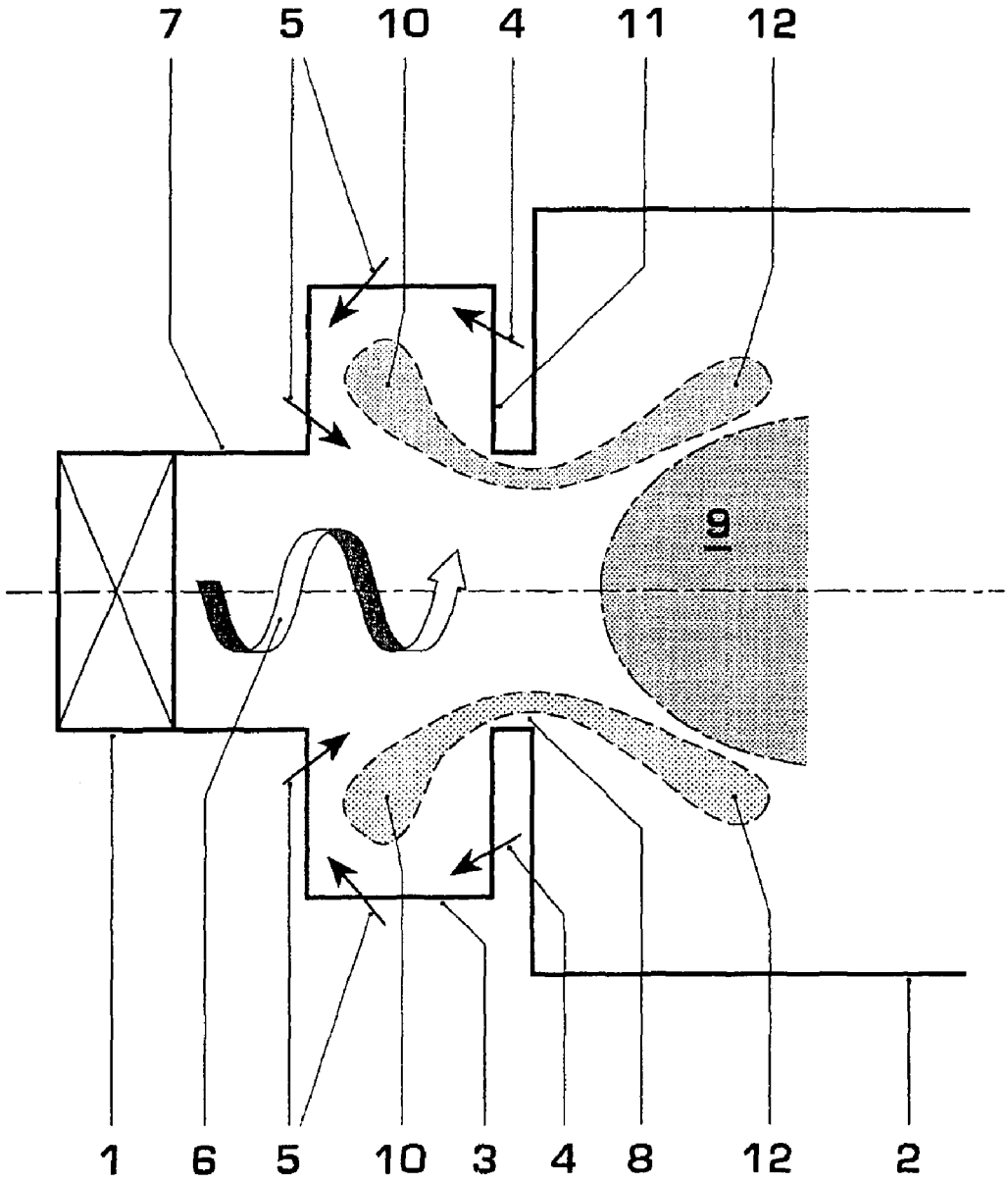
7
5
10
4
11
12
9
1
6
5
10
3
4
8
12
2

BURNER AND PILOT BURNER

FIELD OF THE INVENTION

The invention is based on a burner and on a pilot burner.

DISCUSSION OF BACKGROUND

Burners, in particular premix burners, are normally equipped with an additional pilot burner in order to ensure stable combustion over a wide operating range, in particular at no-load and within the partial-load range.

In the case of the premix burner, a "double-cone burner", disclosed by EP 0 321 809 A1, this pilot burner is realized by fuel being injected in the center of the cone. The gas flowing into the interior space of the double-cone burner burns in a diffusion flame stabilized deep within the interior space of the burner.

EP 0 704 657 A2 discloses a further premix burner in which the pilot burner is realized by fuel flowing from an annular gas duct having outlet holes inclined outward into the outer backflow zone of the combustion chamber downstream of the burner exit. The outflowing gas burns in a diffusion flame stabilized by the jump in cross section at the burner exit.

Both embodiments of burner and pilot burner disclosed by the abovementioned documents ensure stable combustion over a wide range of 10 to 100% pilot-gas proportions. However, these known systems also have some disadvantages.

Even small quantities of, for example, 10% pilot gas may lead to markedly increased pollutant emissions, since the flames work in diffusion operation. This is undesirable in particular during part-load operation. In order to achieve large extinction distances, pilot-gas proportions of up to 100% are necessary, which may lead to very high emission values within the starting range and the low load range.

In the embodiment of the internal piloting according to EP 0 321 809 A1, it is possible in certain designs for bimodal flame stabilization to occur during the switch-over operation from pilot to premix combustion. That is to say that the anchoring point of the flame is not clearly defined and varies dynamically between pilot flame stabilized in the burner and premix flame stabilized on the outside, which may lead to the excitation of thermoacoustic instabilities. In the embodiment of the external piloting according to EP 0 704 657 A2, the stabilizing of the pilot flames in annular combustion chambers may be adversely affected, since pronounced transverse flows may form in the outer recirculation zones in a multiburner arrangement.

SUMMARY OF THE INVENTION

The object of the invention, in the case of a burner and a pilot burner of the type mentioned at the beginning, is to modify the burner in such a way that the abovementioned disadvantages are removed.

The essence of the invention is thus that a cavity is arranged between the swirl generator and the combustion chamber, in which cavity a secondary flow can be produced.

The advantages of the invention may be seen, inter alia, in the fact that the exhaust gases, acting in a stabilizing manner, of the pilot flames are not produced by gas flows extending freely into the burner or combustion space but in a secondary flow of a separate cavity, which according to the invention is arranged upstream of the burner outlet leading into the combustion chamber.

From the fluidic point of view, a congenial swirl-shaped hot-gas flow is formed inside this annular toroidal interior space. In this case, the gas- and secondary-air nozzles distributed over the circumference of the toroidal interior space have an assisting effect on the congenial swirl flow, which is primarily imposed by the swirl flow of the main flow.

An air/gas mixture occurs in the cavity proposed here, the air coefficient of this air/gas mixture being formed from the setting parameters inflow rate of the pilot gas, inflow rate of the secondary air and turbulent exchange with the premixed air/gas mixture from the main flow.

If this mixture lies within the range of the rich and lean extinction limits, the mixture ignites. In the embodiment according to the invention, ignition can always be expected, since the average retention times in the cavity exceed the self-ignition times to be expected.

The hot jet produced in this way escapes from the cavity at the downstream end and is deflected into the shear layer of the adjoining expansion. It has the desired effect there of additionally stabilizing the swirl premix flame, which is stabilized at the outer secondary backflow zone on the one hand and at the inner backflow zone on the other hand.

The congenial swirl flow in the cavity therefore permits rapid intermixing of fuel and secondary air. A combustion rate which has the character of premix combustion with very low emissions of NOx, CO and UHC is thus achieved in the cavity. The cavity and the secondary flow produced in it may therefore also be used for pure premix combustion, that is to say in order to stabilize the flame and avoid pulsations, and this without actual pilot functions.

The combustion stability in the cavity is independent of the flow through the main burner; thus very large variations in the air coefficient can be realized with this system.

The centrifugal-force zone in the cavity reduces the convective heat transfer on account of the gas centrifuge effect to a minimum. Concave shaping of the cavity maximizes this effect. As a result, the quantity of the cooling medium used can be minimized.

BRIEF DESCRIPTION OF THE DRAWING

Exemplary embodiments of the invention are explained in more detail below with reference to the drawings. The same elements are provided with the same designations in the various figures. The direction of flow of the media is indicated by arrows.

In the drawing:

FIG. 1 shows a partial longitudinal section through a burner according to the invention with adjoining combustion chamber.

Only the elements essential for directly understanding the invention are shown.

WAYS OF IMPLEMENTING THE INVENTION

In the single FIG. 1, a combustion chamber 2 is arranged downstream of a swirl generator 1. The swirl generator used may be, for example, a premix burner as disclosed by EP 0 321 809 A1 or EP 0 704 657 A2, which hereby form an integral part of this description. The swirl generator may thus comprise at least two hollow, conical sectional bodies nested one inside the other in the direction of flow. The respective longitudinal symmetry axes of the sectional bodies run offset from one another, so that the adjacent walls of the sectional bodies, in longitudinal extent, form tangential ducts, via which the combustion air can enter the conical hollow space formed by the sectional bodies. Fuel may be injected, for example, via fuel nozzles arranged in the conical hollow space or via lines arranged along the tangentially running ducts.

The swirl generator 1 may be connected to the combustion chamber 2 via a tube 7, the tube serving as a mixing tube. In the region of the swirl generator, fuel, via means which are not shown, is admixed with the air fed via a compressor (not shown), and thus produces a main flow 6, which enters the combustion chamber 2 via the tube 7. A defined mixing section can be provided by the tube 7, as a result of which perfect premixing of fuels of various type is achieved. At the transition from the tube 7 to the combustion chamber 2, a central backflow zone 9 forms in the region of the burner exit 8 due to the jump in cross section there, this backflow zone 9 having the property of a flame retention baffle for the premix flame occurring after ignition.

Arranged between the swirl generator 1 and the combustion chamber 2 in the region of the tube 7 is a cavity 3, which is shaped in an annular toroidal manner and such as to be open toward the interior region of the tube 7. In this case, the preferred distance between the cavity 3 and the burner exit 8 is to be selected to be as small as possible. Pilot-gas nozzles 4 and secondary-air nozzles 5 are arranged over the circumference of the cavity 3. By the swirl flow of the main flow 6, a secondary flow 10 is produced as congenial swirl flow in the cavity. In the process, the pilot-gas nozzles 4 and the secondary-air nozzles 5 arranged over the circumference of the cavity 3 have an assisting effect on the secondary flow 10. In this case, the pilot-gas nozzles 4 and secondary-air nozzles 5 are arranged in the cavity 3 at an angle relative to the wall of the cavity in such a way that the secondary swirl flow is intensified in the best possible manner. The optimum angle is obtained from the swirl coefficient and from the dimensions of the cavity 3 and is typically within a range of 30° to 75°.

In the cavity 3, an air/gas mixture therefore occurs in the secondary flow 10, the air coefficient of this air/gas mixture being formed from the setting parameters inflow rate of the pilot gas 4 in the cavity 3, inflow rate of the secondary air 5 in the cavity 3 and turbulent exchange with the premixed air/gas mixture from the main flow 6. If the air/gas mixture in the secondary flow 10 lies within a range within the rich and lean extinction limits, the mixture ignites. Ignition can normally always be expected, since the average retention times in the cavity exceed the self-ignition times to be expected.

The hot jet, produced in this way, of the secondary flow 10 escapes from the cavity 3 at the downstream end 11 and is deflected into the shear layer of the adjoining jump in cross section. A secondary backflow zone 12 is produced by the jump in cross section at the burner exit 8.

The hot jet of the secondary flow 10 therefore has the desired effect there of additionally stabilizing the premix flame, which is stabilized at the outer secondary backflow zone 12 on the one hand and at the inner backflow zone 9, produced by the main flow 6, on the other hand. In the preferred embodiment, the mass flows required for stabilizing the main flame are below 20% of the total mass flow.

The congenial swirl flow in the cavity therefore permits rapid intermixing of fuel and secondary air. In the process, the outer region acts as mixing zone, whereas the flame forms in the core region of the cavity. A combustion quality which approaches the character of premix combustion with very low emissions of NOx, CO and UHC is thus achieved in the cavity 3. The pilot functions may in this case also be effected in a conventional manner, that is to say, for example, by additional fuel injection into the swirl space of a double-cone burner.

The combustion stability in the cavity is independent of the flow through the main burner; thus very large variations in the air coefficient can be realized with this system.

The invention is of course not restricted to the exemplary embodiment shown and described. The swirl generator may assume any desired shape and may for example be composed of elements other than those described above. It is essential that a swirl flow is produced.

LIST OF DESIGNATIONS

1 Swirl generator
2 Combustion chamber
3 Cavity
4 Pilot-gas nozzles
5 Secondary-air nozzles
6 Main flow
7 Tube
8 Burner exit
9 Backflow zone
10 Secondary flow
11 End of cavity downstream
12 Secondary backflow zone

What is claimed is:

1. A burner for a heat generator, comprising:

a swirl generator for a combustion-air flow and means for injecting fuel for producing a main flow;

a combustion chamber arranged downstream of the swirl generator;

a cavity arranged between the swirl generator and the combustion chamber, in which cavity a secondary flow can be produced that encloses the main flow wherein the secondary flow is configured and arranged to be used as a pilot flame.

2. The burner as claimed in claim 1, wherein the cavity has an annular toroidal shape.

3. The burner as claimed in claim 1, further comprising injection means for fuel and for combustion air arranged in the cavity.

4. The burner as claimed in claim 1, further comprising a mixing section arranged between the swirl generator and the cavity.

5. The burner as claimed in claim 1, further comprising a mixing section arranged between the cavity and the combustion chamber.

* * * * *